US006811161B1

(12) United States Patent
Anderson

(10) Patent No.: US 6,811,161 B1
(45) Date of Patent: Nov. 2, 2004

(54) FIRE ENGINE HAVING EXTENSION LADDER AND LATERAL STABILIZERS

(75) Inventor: Richard W. Anderson, West Jefferson, OH (US)

(73) Assignee: Sutphen Corporation, Amlin, OH (US)

( * ) Notice: Subject to any disclaimer, the term of this patent is extended or adjusted under 35 U.S.C. 154(b) by 0 days.

(21) Appl. No.: 10/060,576

(22) Filed: Jan. 29, 2002

Related U.S. Application Data

(60) Provisional application No. 60/314,442, filed on Aug. 23, 2001.

(51) Int. Cl.[7] ..... A62C 27/00; E06C 5/00

(52) U.S. Cl. ..... 280/4; 182/19; 280/766.1

(58) Field of Search ..... 280/4, 763.1, 765.1, 280/766.1, DIG. 1; 180/54.1, 68.2; 182/18, 19, 64.1, 65.1, 68.1, 69.4, 69.6, 2.8; 254/421, 423, DIG. 9

(56) References Cited

U.S. PATENT DOCUMENTS

| | | | | | |
|---|---|---|---|---|---|
| 3,752,261 | A | * | 8/1973 | Bushnell, Jr. | 182/17 |
| 4,142,710 | A | * | 3/1979 | Okuda | 254/423 |
| 4,624,357 | A | * | 11/1986 | Oury et al. | 198/313 |
| 4,941,546 | A | * | 7/1990 | Nist et al. | 182/17 |
| 5,117,595 | A | * | 6/1992 | Brendel | 52/115 |
| 5,706,960 | A | * | 1/1998 | Pitman et al. | 212/304 |
| 5,868,218 | A | * | 2/1999 | Lawson | 182/69.6 |
| 6,276,718 | B1 | * | 8/2001 | Wolfram et al. | 280/765.1 |

FOREIGN PATENT DOCUMENTS

| | | | |
|---|---|---|---|
| DE | 4311662 | * | 4/1993 |
| GB | 2262721 | * | 6/1993 |
| JP | 5-32398 | * | 2/1993 |

* cited by examiner

*Primary Examiner*—Anne Marie Boehler
(74) *Attorney, Agent, or Firm*—Roger A. Gilcrest

(57) ABSTRACT

A fire engine having an extension ladder mounted thereto, wherein said extension ladder may be rotated through a full 360 degrees while the ladder is fully extended—regardless of the vertical angle or position of the ladder with respect to the longitudinal axis of the fire engine. The ladder is mounted to the fire engine between a forward portion and a rearward portion. The fire engine employs at least two sets of vertically offset and laterally extendable stabilizers, that are adapted to communicate with the ground and stabilize the fire engine while the ladder is in use. The stabilizers are mounted substantially beneath the mounting point of the ladder and are designed to reside within the width of the fire engine body when retracted. Each set of stabilizers is arranged to diverge in the direction of extension in order to provide maximum stabilization to the fire engine.

44 Claims, 16 Drawing Sheets

FIRE ENGINE HAVING EXTENSION LADDER AND LATERAL STABILIZERS

This application claims benefit under 35 U.S.C. 1.19(e) of U.S. Provisional Application No. 60/314,442, filed Aug. 23, 2001, and entitled "Fire Engine Having Extension Ladder And Lateral Stabilizers".

TECHNICAL FIELD OF THE INVENTION

The present invention relates to the field of mobile fire engines, and particularly to fire engines having extension ladders. The present invention is directed to a system of stabilizing the fire engine when the extension ladder is in use, such that an extension ladder of substantial length may be employed and operated through a full range of motion. The present invention is also directed to a fire engine utilizing the stabilizing system, wherein the stabilizing system and extension ladder are located for maximum stabilization.

BACKGROUND OF THE INVENTION

Fire engines are well known machines utilized in fighting fires. Typically, fire engines are designed to carry multiple occupants and a plethora of equipment that may be needed at a fire scene. Fire engines are generally equipped with pumping systems that can pump water through hoses to the location of a fire. These pumping systems normally communicate with a water tank located within the body of the fire truck, and are also adapted to pump water from a city water supply via, for example, a fire hydrant, or from a body of water.

In small towns, or in areas without large buildings, these fire engines may simply carry hand operated step or extension ladders to allow the firefighters called to a fire to reach the necessary areas. However, in large cities or areas with buildings and other structures of substantial height, hand-operated ladders have insufficient reach to allow access to all parts of a structure. To this end, powered extension ladders were developed and mounted to fire engines so that firefighters and their equipment could reach elevated areas. These powered extension ladders permit firefighters to be elevated to a position wherein they can attack a fire from above. Hoses and other equipment may be transported by the ladder along with the firefighters. Such extension ladders have also proven useful in effecting the rescue of occupants from burning buildings. As fires may start in the lower levels of tall buildings, it is sometimes the case that occupants on upper levels will not become aware of a fire until the fire is in such an aggravated state that passage out of the building through the lower levels is impossible. In such a case, the powered extension ladder of the fire engine can be used to remove trapped occupants through upper level windows. Of course, rescue operations are not limited to the victims of fire, and such fire engines may be called whenever a high elevation rescue is necessary.

As we continue to construct buildings of increasing height, however, longer extension ladders are needed to reach the rising upper levels. Unfortunately, longer ladders are also heavier, which poses a problem not only as to ladder construction, but also to the stability of the fire engines to which they are mounted. The weight of these longer ladders combined with the various positions into which they may be placed, may exert such a moment on the fire engine to which they are attached that the fire engine can become unstable. For this reason, stabilizing systems have been added to these fire engines, wherein additional bracing points are provided between the fire engine and the ground to maintain stability while the extension ladder is in use.

There are known fire engines having powered extension ladders of 100 to 110 feet. However, these known fire engines are limited in that they are unable to move the ladder through a full range of motion due to the instability imparted thereby. Even when employing remote stabilizers, these known fire engines have required that the attached ladders be confined to a limited range of motion. Especially problematic has been the situation wherein the ladder is placed in an extended position and rotated to project outward substantially laterally to the length of the fire engine. This situation is further exacerbated as the angle of the ladder approaches horizontal. It is in this position that the most severe moment is imparted to the fire engine, as the weight of the ladder is disposed at close to a right angle to its attachment on the fire engine. For this reason, known fire engines with extension ladders in this length range prohibit placement of the ladder in such a position, thereby circumventing any dangers that could result from the possible instability of the fire engine. Therefore, what is. needed is a fire engine having an extension ladder of 100 feet or more, wherein the extension ladder may be moved through a full range of motion.

SUMMARY OF THE INVENTION

The fire engine of the present invention satisfies the need for a fire engine having an extension ladder of a length in excess of 100 feet, wherein the extension ladder may be safely moved through a full range of motion while the ladder is fully extended without. The fire engine of the present invention has an extension ladder mounted thereto, which extension ladder can be extended to a length of approximately 110 feet. The extension ladder is mounted to a turntable on the fire engine, thereby imparting 360 degrees of rotation to the extension ladder. The extension ladder is moveable from a storage position that is substantially horizontal to the ground, to a fully upright position that is substantially perpendicular to the ground. The extension ladder can be placed in any rotational position regardless of the orientation of the extended ladder with respect to the ground, thus, the ladder may be fully extended laterally from the fire engine, even when the ladder is substantially horizontal to the ground. Not only can the ladder of the fire engine of the present invention support itself in any position, it can also continually support up to 1,000 pounds in payload at any position.

In order to provide the necessary stabilization to the fire engine during use of the ladder, the fire engine is equipped with laterally extending stabilizers. In the present invention, it is preferred that the ladder be rotatably mounted to substantially a center portion of the fire engine. In this manner, longitudinal stability of the fire engine during ladder use may be provided by the cab and engine portion forward of the ladder, and the pump, water tank and other equipment located rearward of the ladder. At least one pair of lateral stabilizers are deigned to extend to either side of the fire engine, from a central portion thereof. The lateral stabilizers are designed to pass substantially through the turntable housing, and beneath the attachment point of the ladder. The lateral stabilizers are comprised of telescoping tubular sections that may be extended laterally outward by internal hydraulic cylinders. Each lateral stabilizer also has a leveling pad that may be extended vertically downward from an end portion of the lateral stabilizer to communicate with the ground. Each pair of lateral stabilizers is preferably arranged to form substantially a "V" shape. The ends of each stabilizer pair that are proximal to the turntable housing are adjacent to one another, with each stabilizer of the pair then diverging as the stabilizers extend laterally outward toward the respective side of the fire engine. This design allows the lateral stabilizers to reside in a compact arrangement when in a retracted position, but to provide stabilizing points over a significant area when extended. To accomplish the "V" shaped orientation of lateral stabilizers through the turntable housing, one pair of lateral stabilizers is disposed above the other pair. Thus, the leveling pads of one stabilizer pair will extend vertically downward a greater distance than the other pair.

While the lateral stabilizers safely permit the ladder to be fully extended and moved through any position, such movement may cause instability of the fire engine and resulting danger should one or more of the stabilizers be less than fully extended and in contact with the ground. Thus, the fire engine of the present invention also preferably monitors the position of each lateral stabilizer to determine the extent to which it has been extended. Preferably, this monitoring system is in communication with the control system of the ladder, and can cause movement thereof to be limited to a particular range based on the position of one or more of the lateral stabilizers.

Therefore, as can be seen, the fire engine of the present invention is especially useful in situations where access to significant heights is required, and further where such access may require that the extension ladder of the fire engine be placed into positions that would impart instability to known fire engines having such ladders. The stabilizers of the fire engine of the present invention allow the fire engine to remain stable even when the ladder is loaded and in its most unfavorable position—extending substantially horizontally and laterally from the fire engine. The design of the lateral stabilizers permits support points to be arranged over a large area, thereby increasing the stability of the fire engine during use of the ladder, while also residing in a compact area while not in use, thereby providing space for other fire engine components or for storage.

BRIEF DESCRIPTION OF THE DRAWINGS

In addition to the novel features and advantages mentioned above, other objects and advantages of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 1:
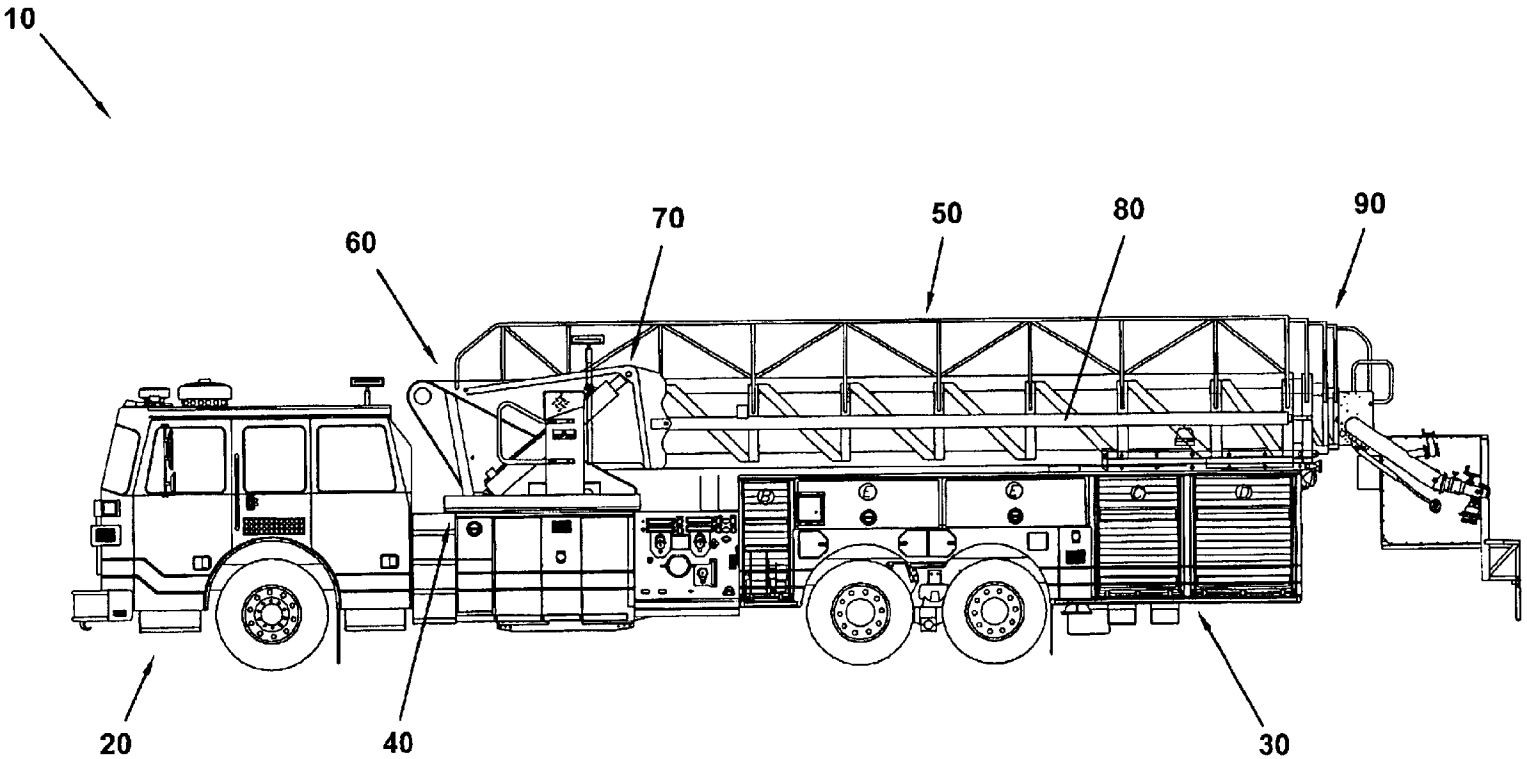
FIG. 1 is a left-side elevational view of an exemplary fire engine of the present invention, having an extension ladder assembly located on a top portion thereof.
Figure 2:
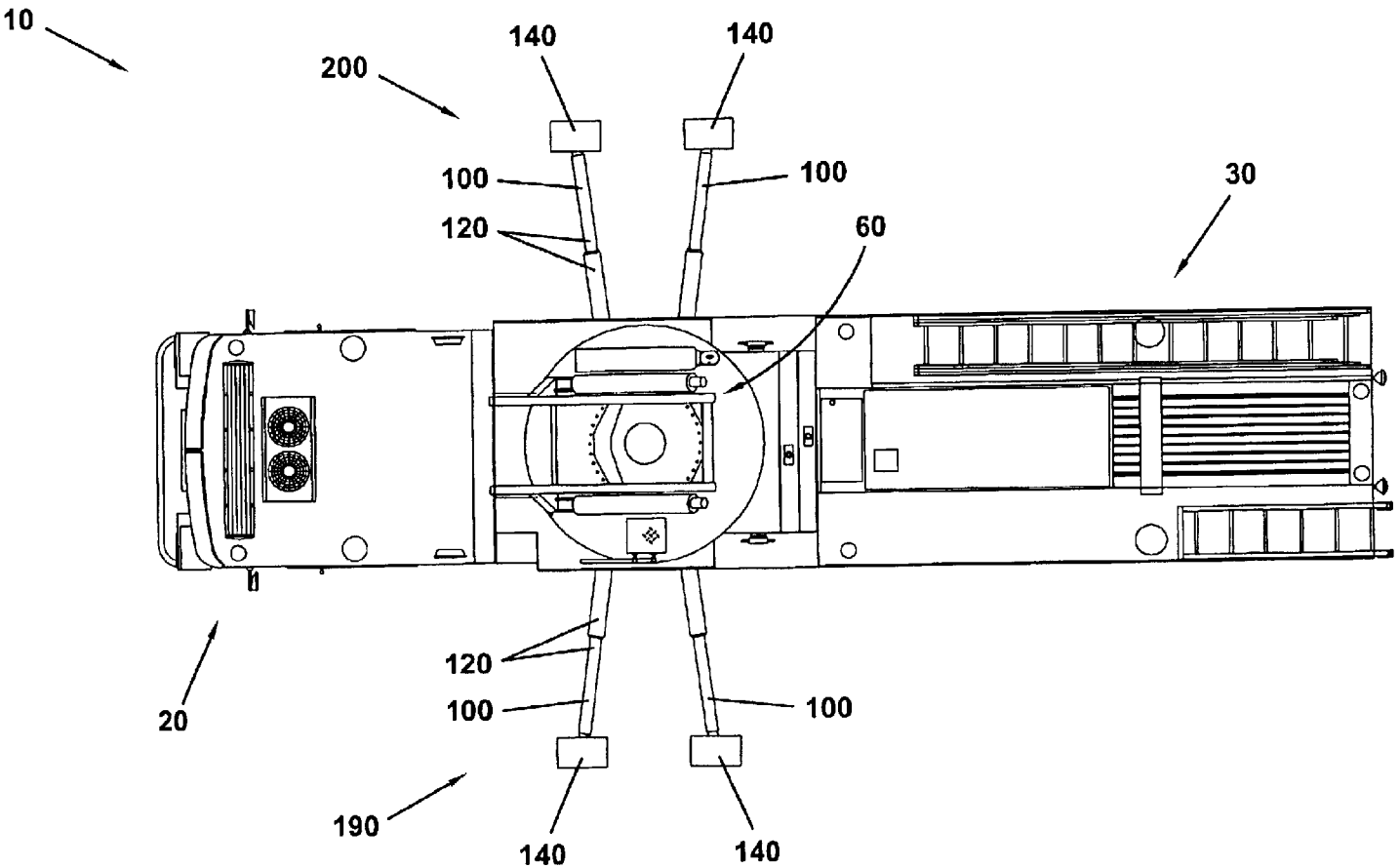
FIG. 2 is a top plan view of the fire engine of FIG. 1, wherein a plurality of lateral stabilizers are shown extending therefrom, and the ladder assembly has been deleted for purposes of clarity.

An exemplary embodiment of a fire engine of the present invention can be observed by reference to FIGS. 1–9. The fire engine 10 can be seen to have a forward portion 20 comprising substantially a cab and an engine and front axle, and a rearward portion 30 that comprises, among other things, the rear axle or axles, a water reservoir, a water pump; and storage areas. The cab of the fire engine may be provided to transport passengers, as is common to such equipment. The pump may be adapted to pump water from the onboard water reservoir and also from a pressurized water supply, such as, for example, a fire hydrant.

A center portion of the fire engine 10 is defined to exist between the forward portion 20 and the rearward portion 30 of the fire engine 10, and preferably between the front and rear axles. A turntable 40 is located substantially at the center portion of the fire engine 10. An extension ladder 50 may be mounted to the turntable 40. More specifically, a proximal end of the extension ladder 50 is preferably secured to the turntable 40 by a ladder support structure 60. By locating the extension ladder 50 and its associated mounting structures between the forward portion 20 and the rearward portion 30, those portions are able to contribute significantly to the longitudinal stability of the fire engine 10 while the ladder is in use.

Figure 3:
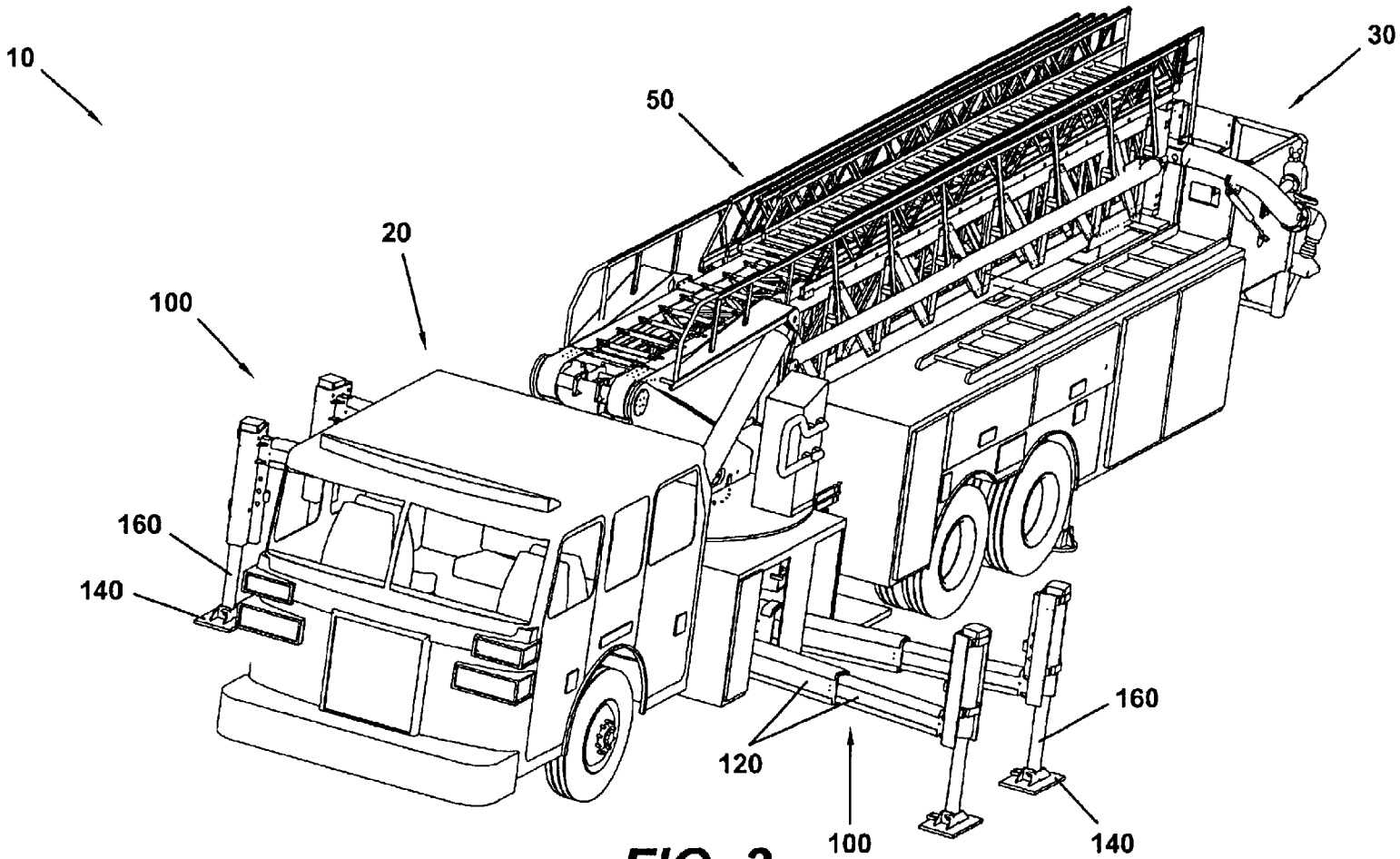
FIG. 3 is a left-front perspective view of the fire engine of FIG. 1, wherein the extended position of the lateral stabilizers can be better observed.
Figure 4:
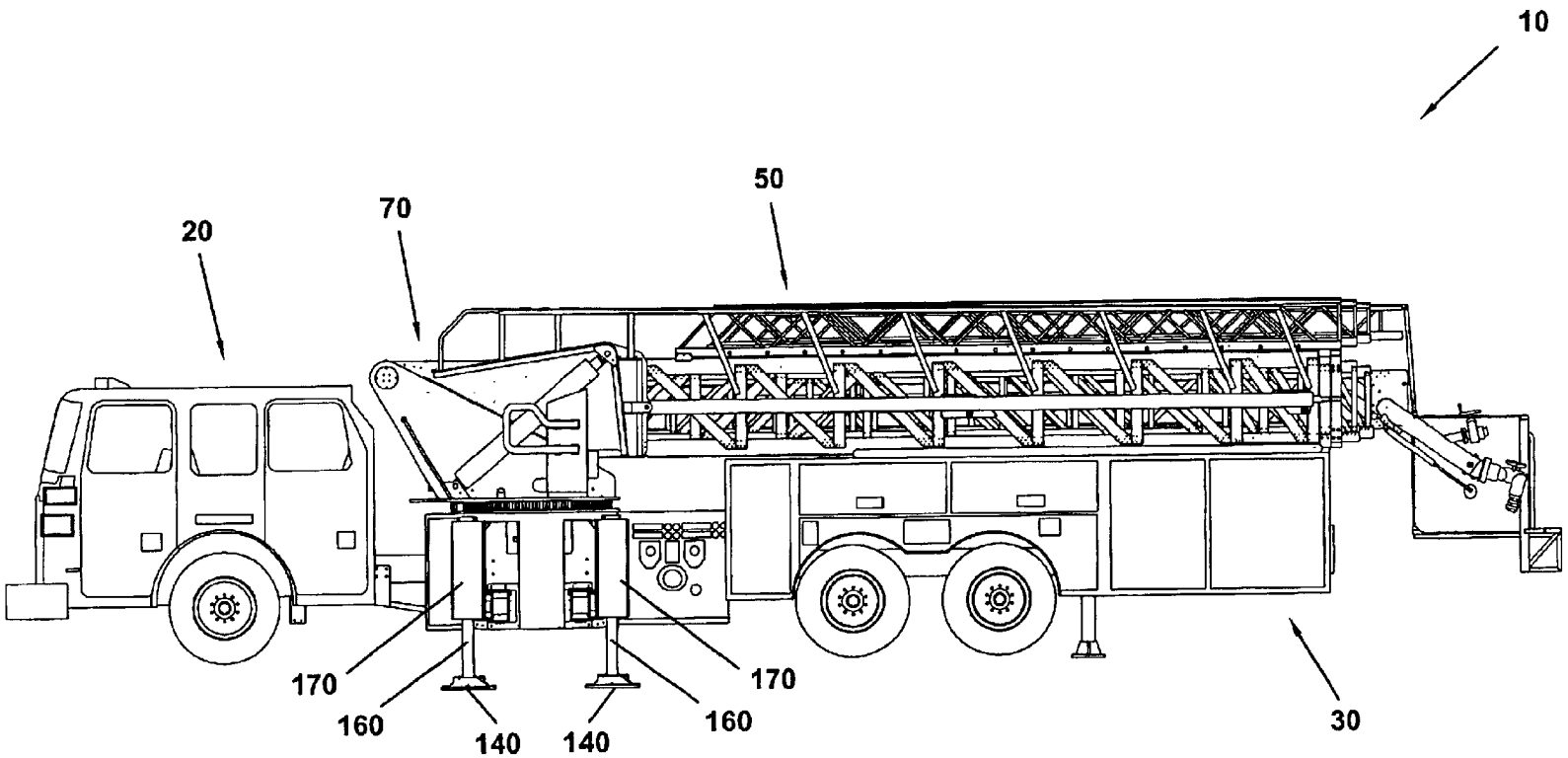
FIG. 4 is an additional left-side elevational view of the fire engine of FIG. 1, with the lateral stabilizers extended as shown in FIGS. 2–3.
Figure 5:
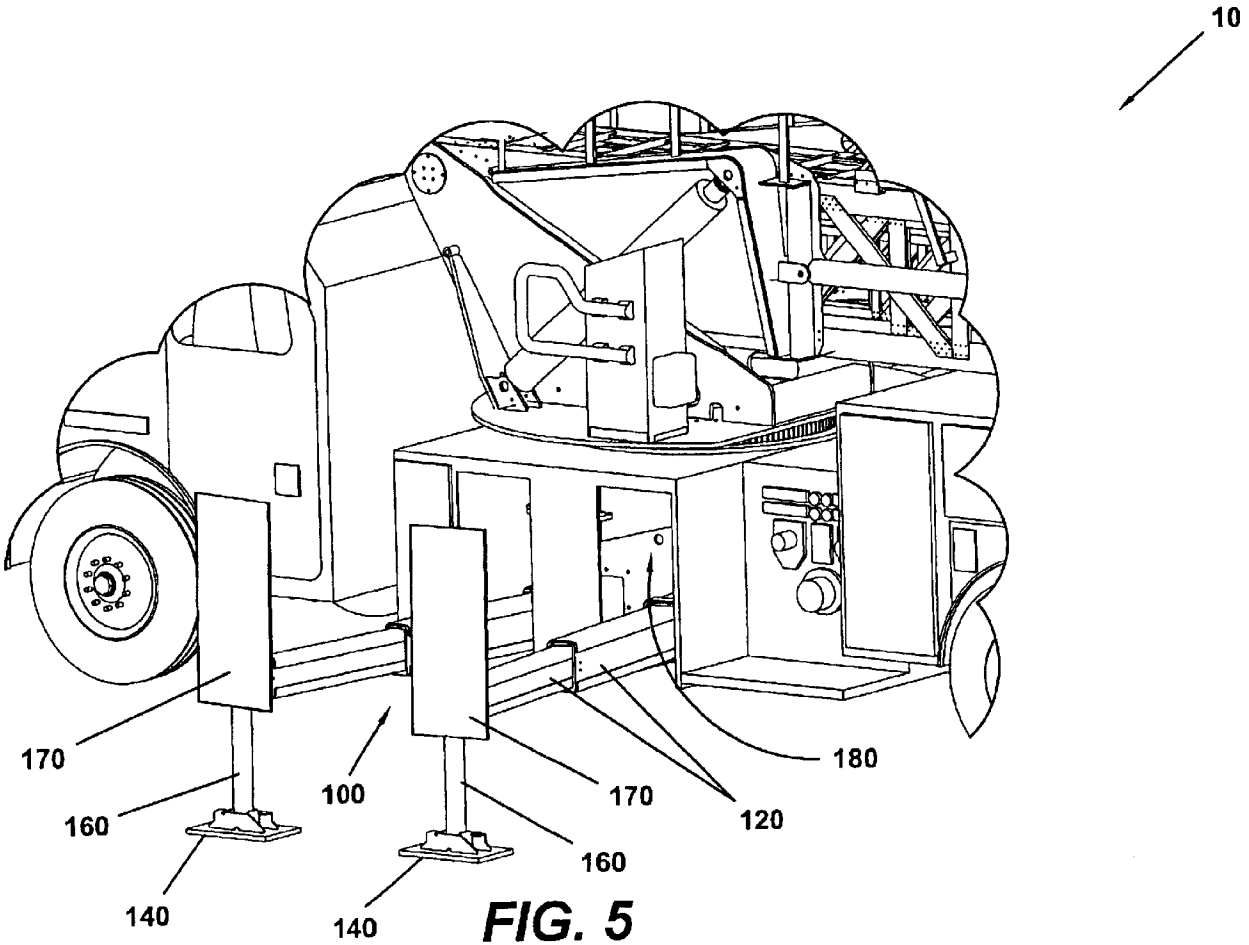
FIG. 5 is an enlarged, left-rear perspective view of the fire engine of FIG. 1, showing the pair of the lateral stabilizers in the extended position of FIGS. 2–4.
Figure 6:
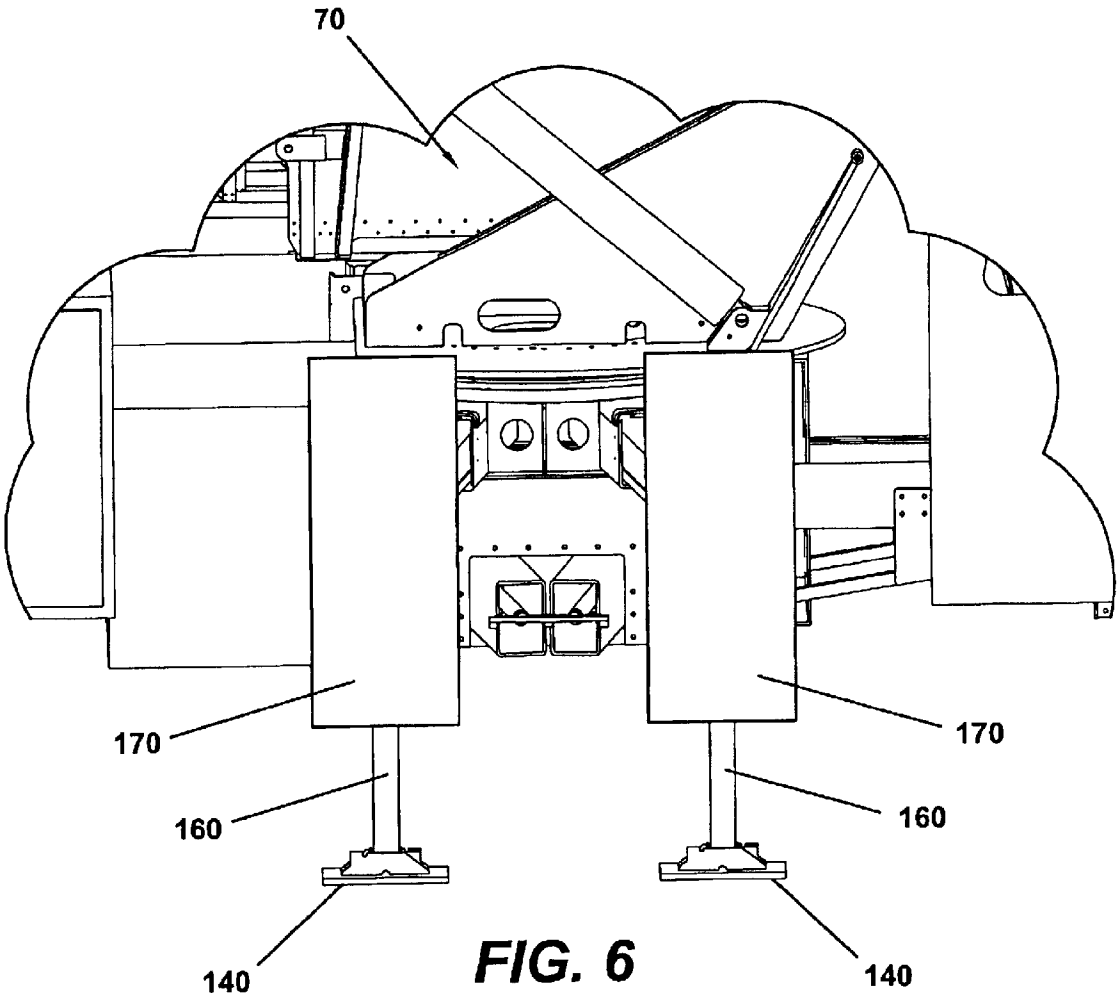
FIG. 6 is an enlarged, right-side elevational view of the lateral stabilizers of FIG. 5, wherein the lateral stabilizers can be seen to pass substantially through a turntable housing portion of the fire engine.
Figure 7:
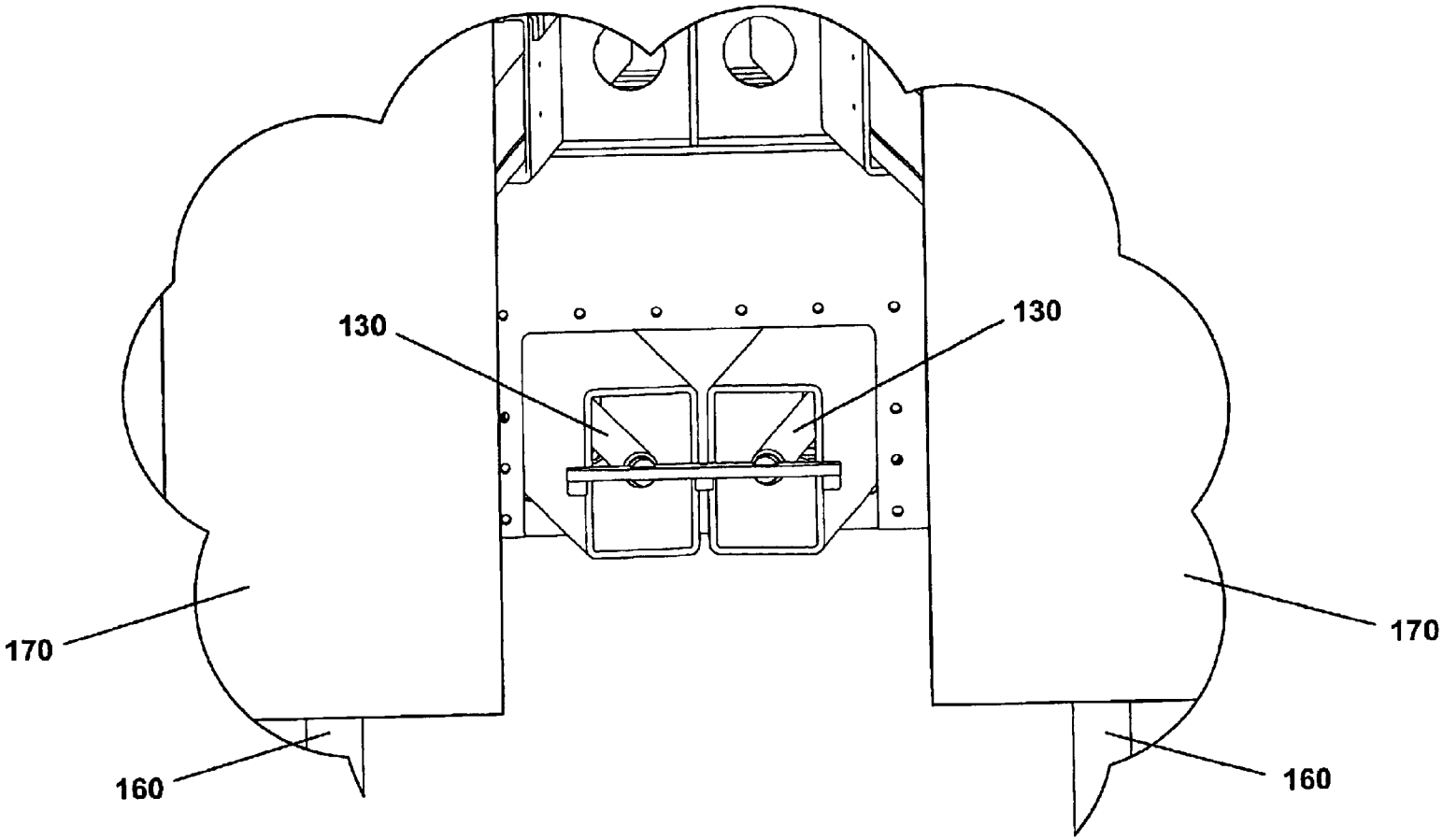
FIG. 7 is an enlarged view of a portion of the turntable housing of FIG. 6, wherein cylinders for operating the lateral stabilizers are visible.
Figure 8:
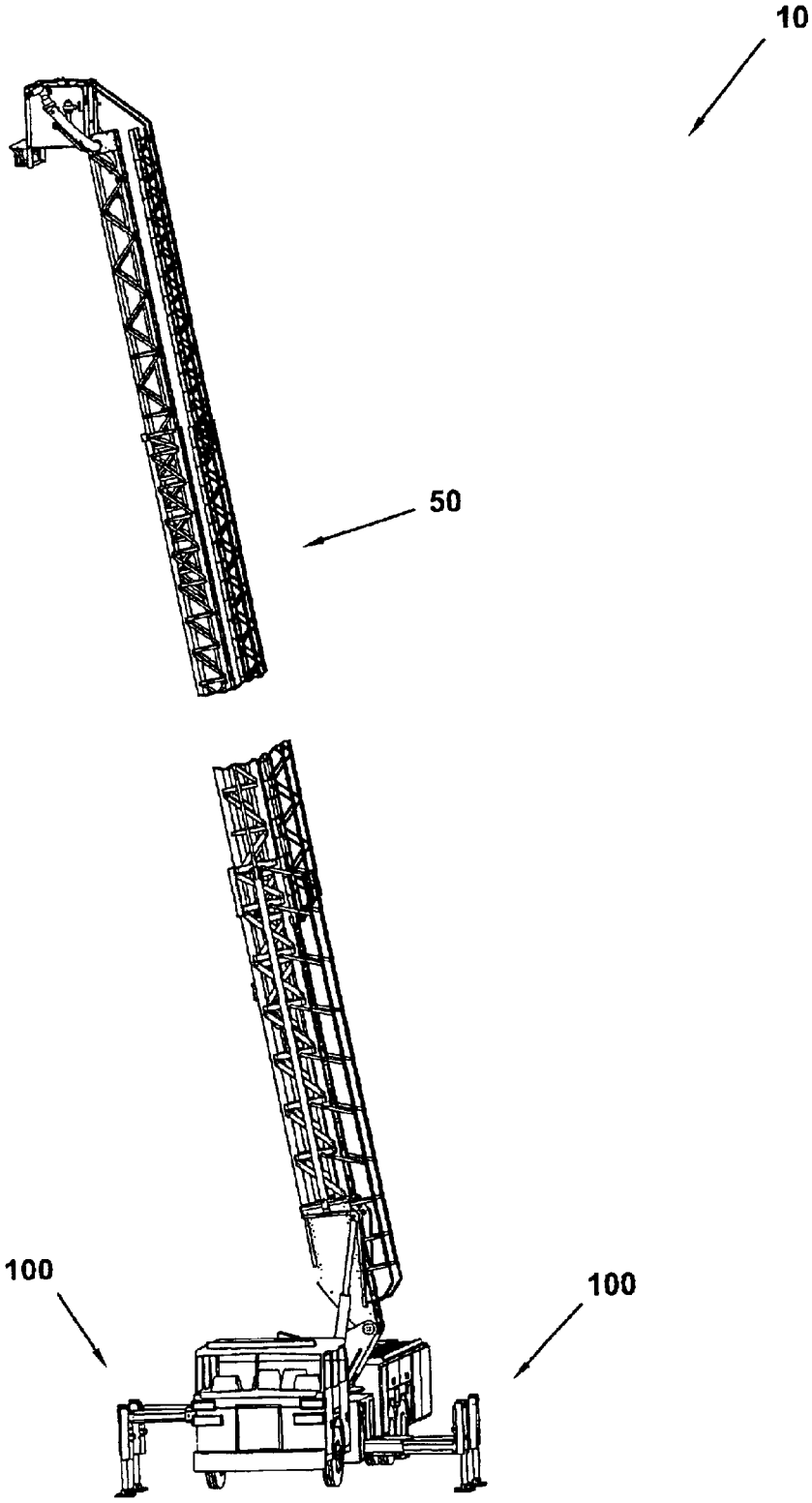
FIG. 8 is a right-front perspective view of the fire engine of FIG. 1, with the lateral stabilizers extended and the ladder in an extended and substantially vertical position.
Figure 9:
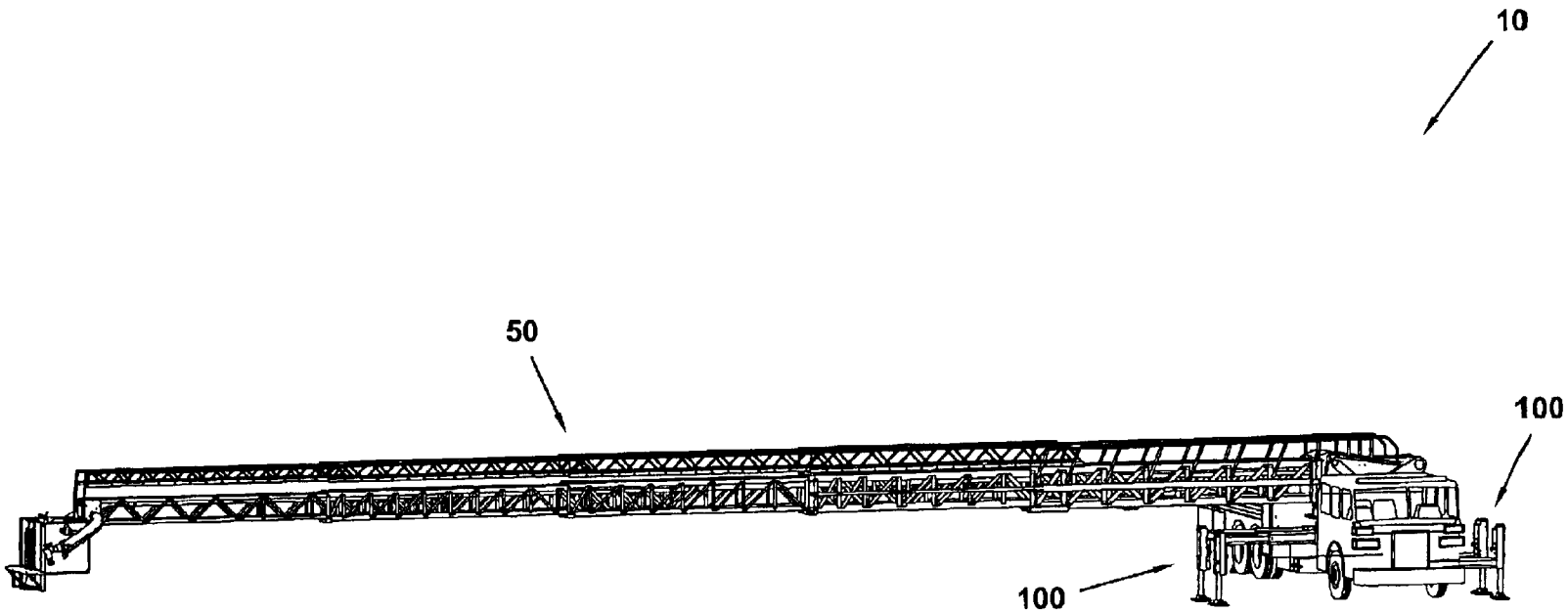
FIG. 9 is a right-front perspective view of the fire engine of FIG. 8, with the ladder in an extended and substantially horizontal position.
Figure 10A:
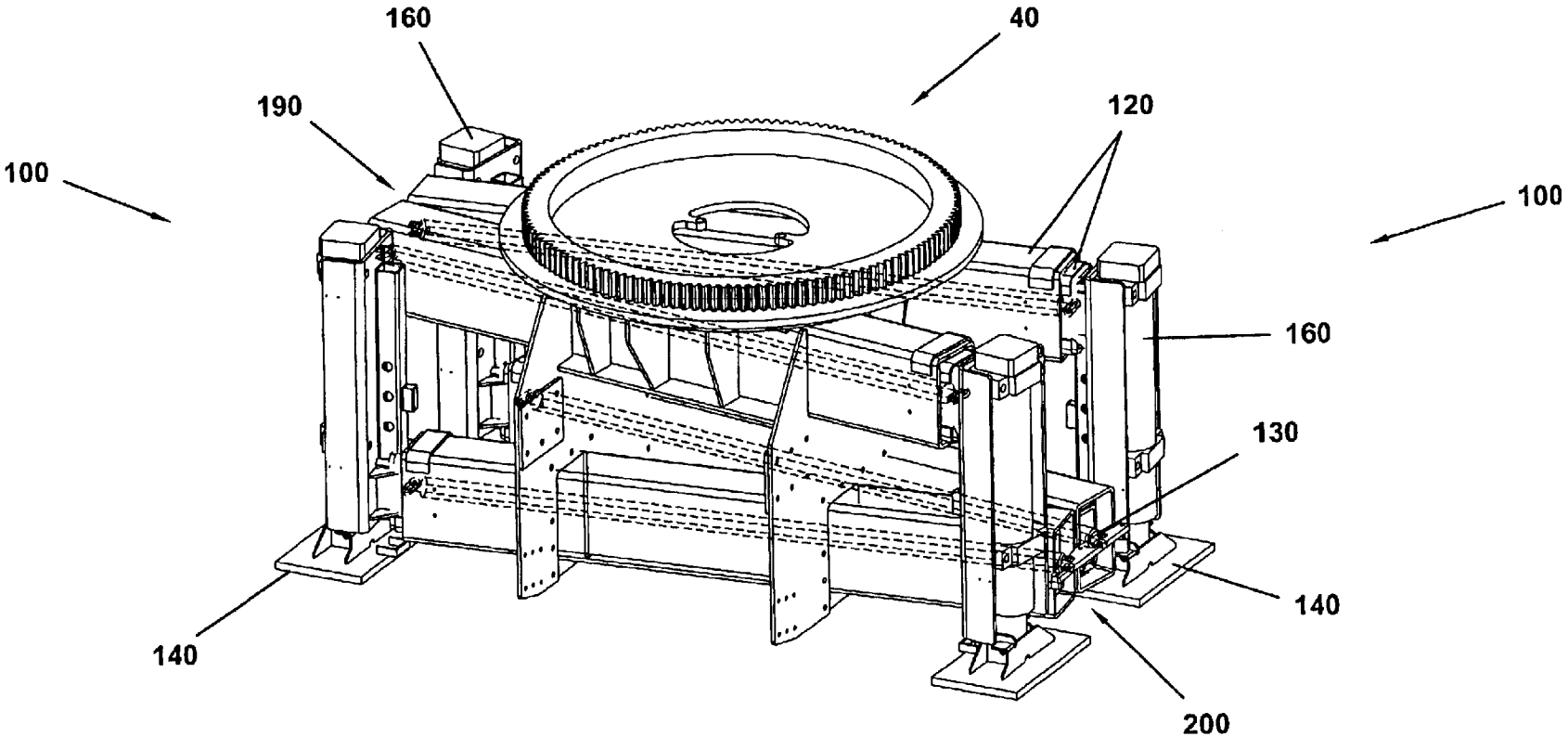
FIG. 10A is an isometric view of the turntable and lateral stabilizer assembly of the fire engine of FIG. 1, wherein the lateral stabilizers can be seen to pass beneath the turntable and are shown in a retracted position.
Figure 10B:
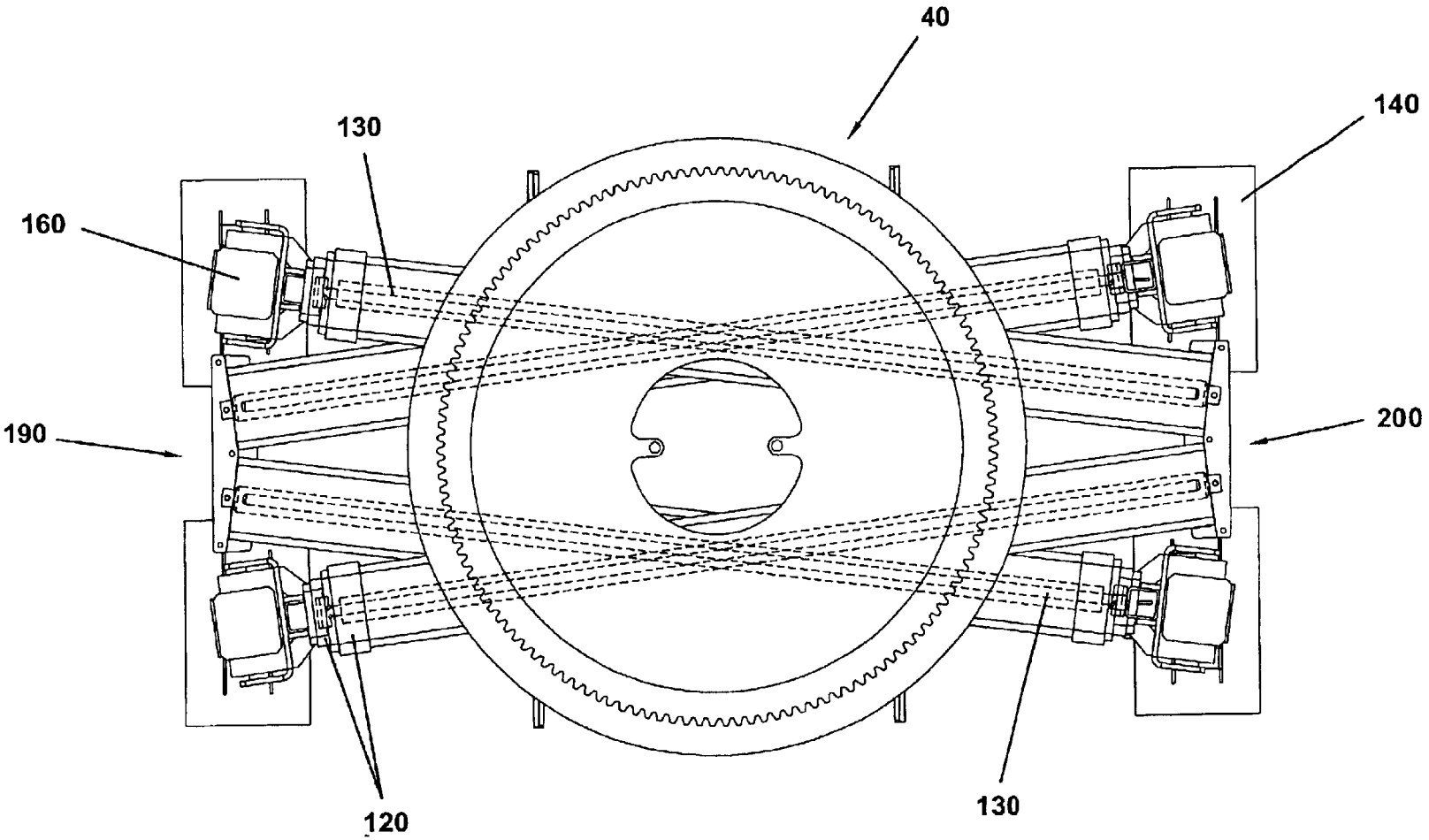
FIG. 10B is a top plan view of the turntable and lateral stabilizer assembly of FIG. 10A.
Figure 11A:
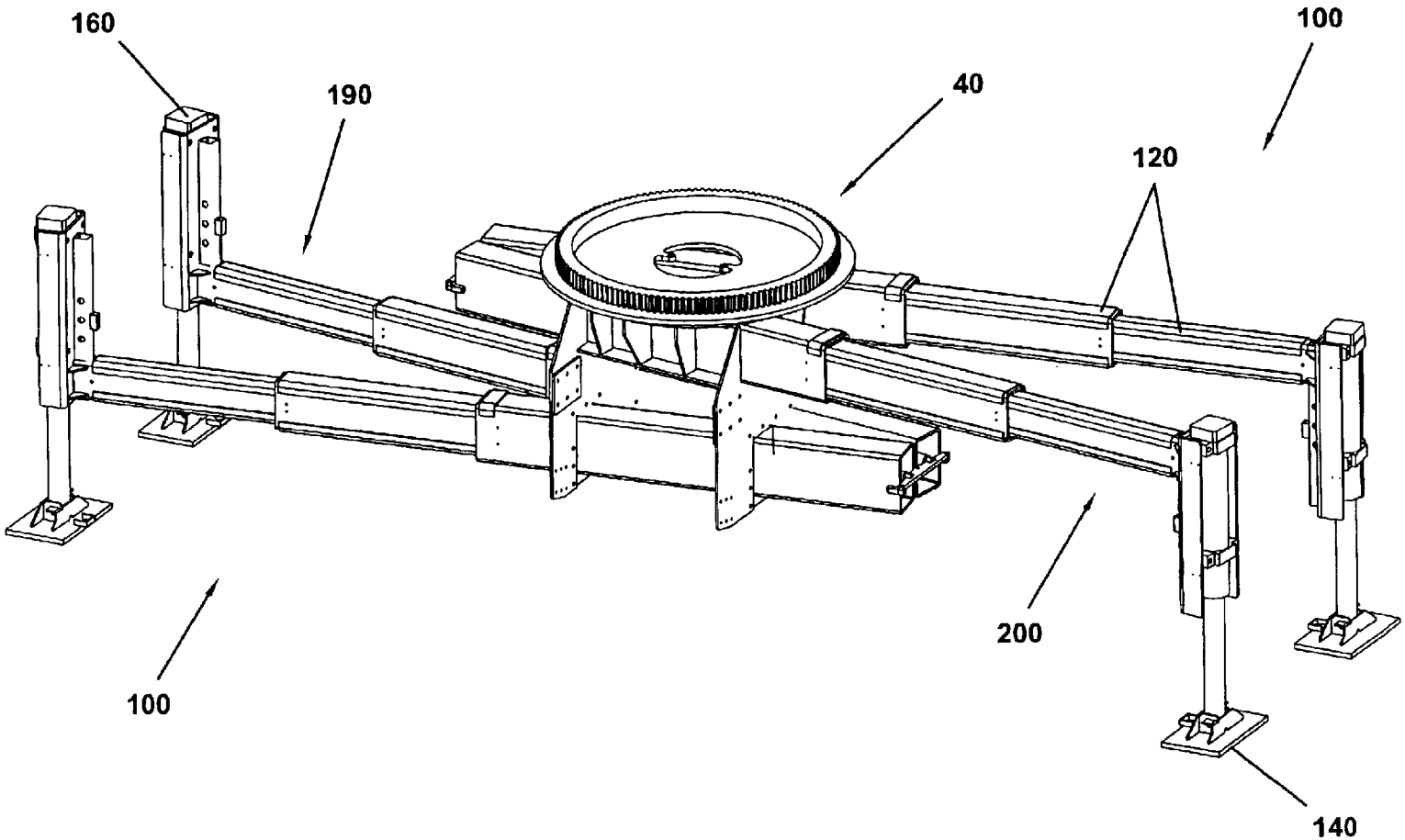
FIG. 11A is an isometric view of the turntable and lateral stabilizer assembly of FIGS. 10A–10B, wherein the lateral stabilizers are shown in an extended position.
Figure 11B:
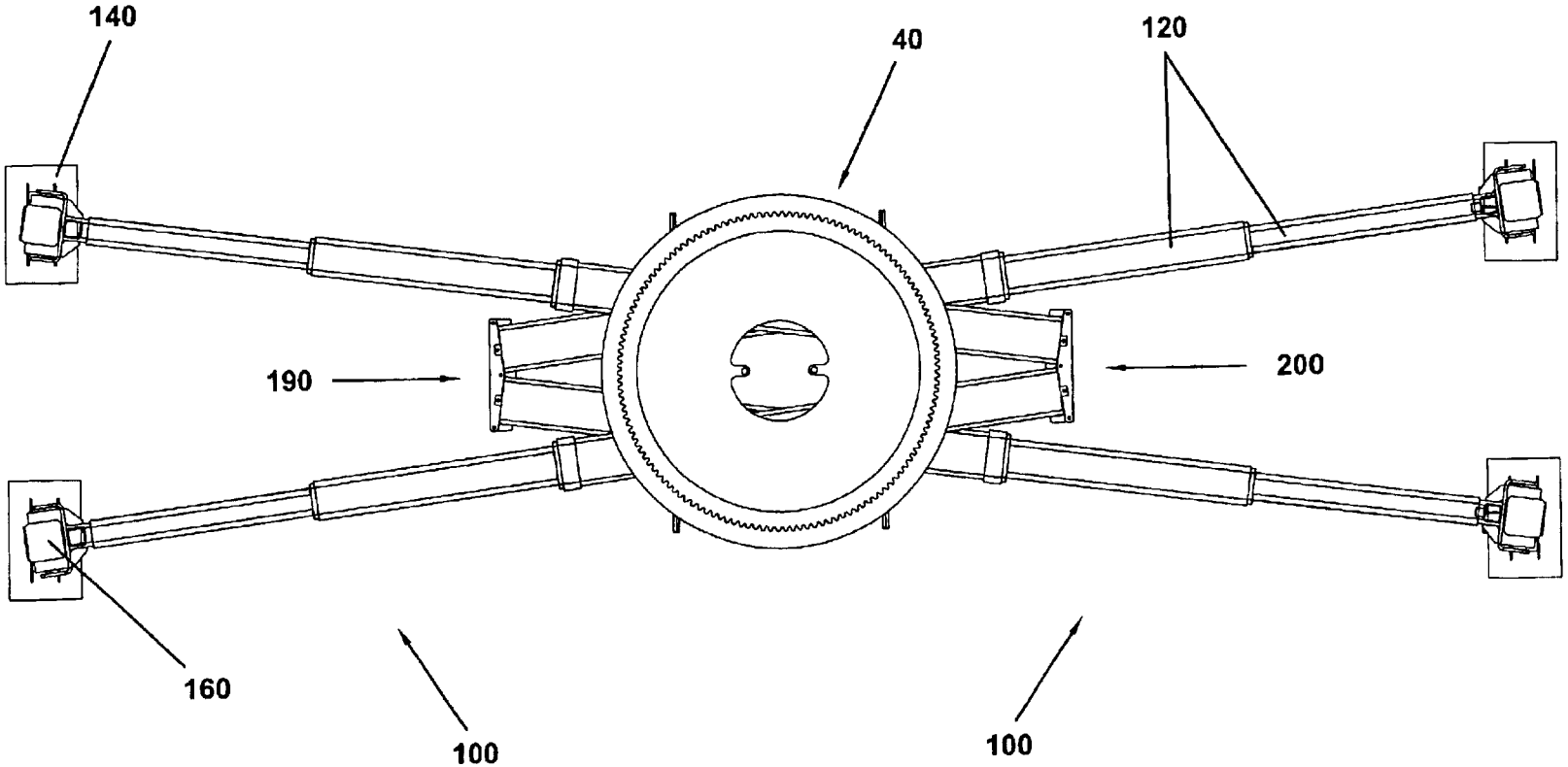
FIG. 11B is a top plan view of the turntable and lateral stabilizer assembly of FIG. 11A.
Figure 12:
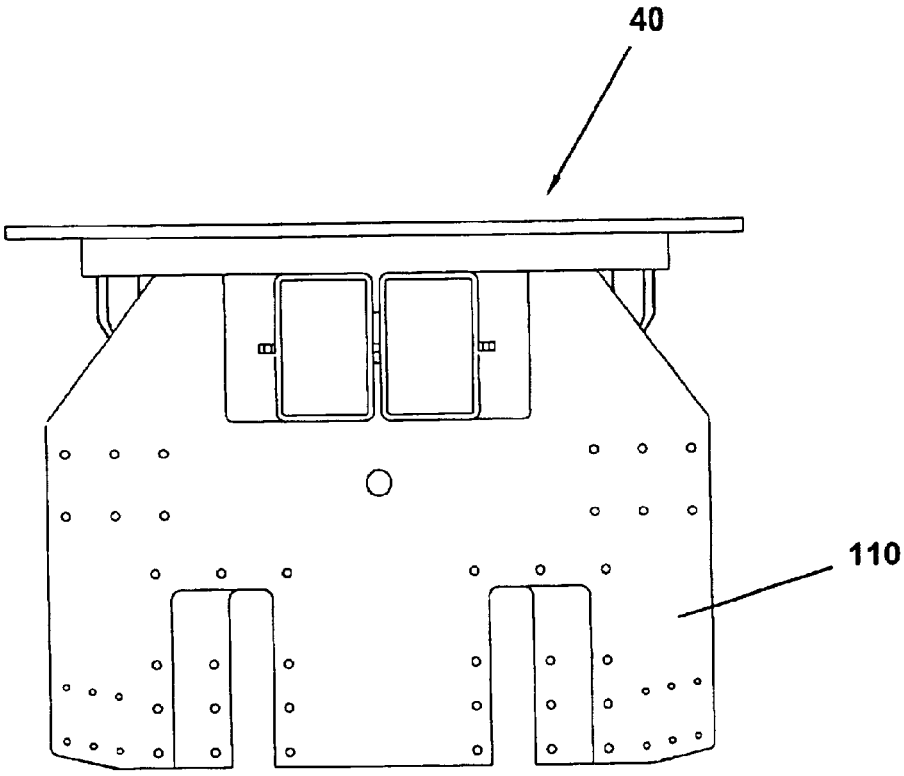
FIG. 12 is a left-side elevational view of the turntable of FIGS. 10–11, wherein a lower housing portion is visible and the diverging ends of an upper pair of lateral stabilizers is indicated.
Figure 13:
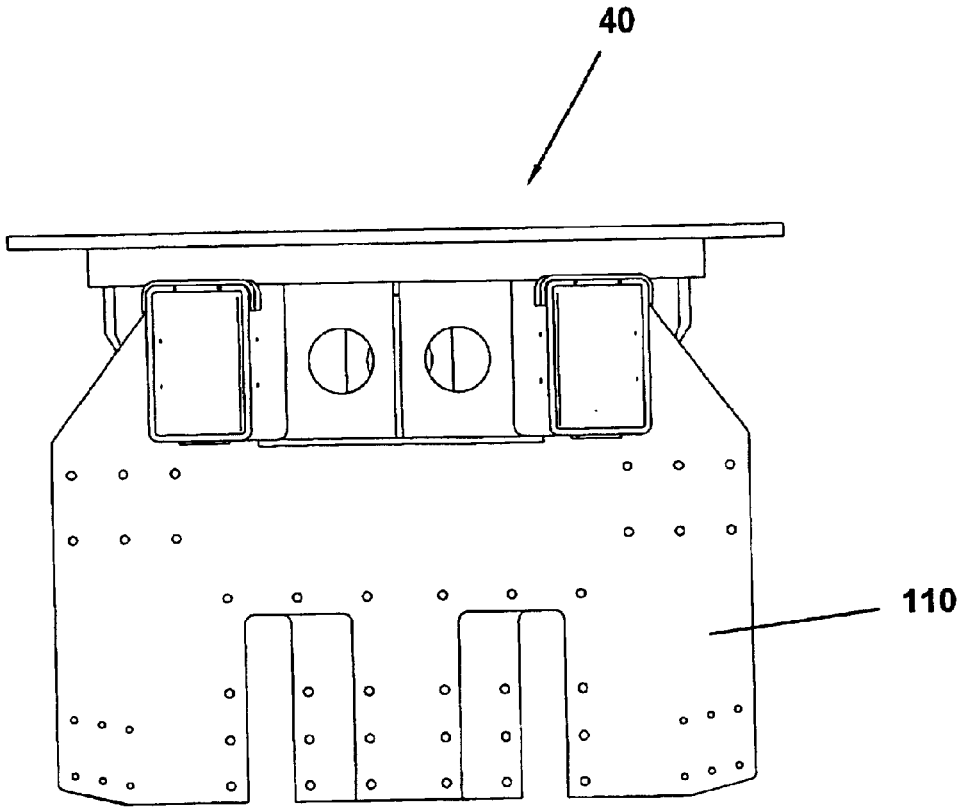
FIG. 13 is a right-side elevational view of the turntable of FIG. 12, wherein the lower housing portion is visible and the converging ends of the upper pair of lateral stabilizers is indicated.
Figure 14:
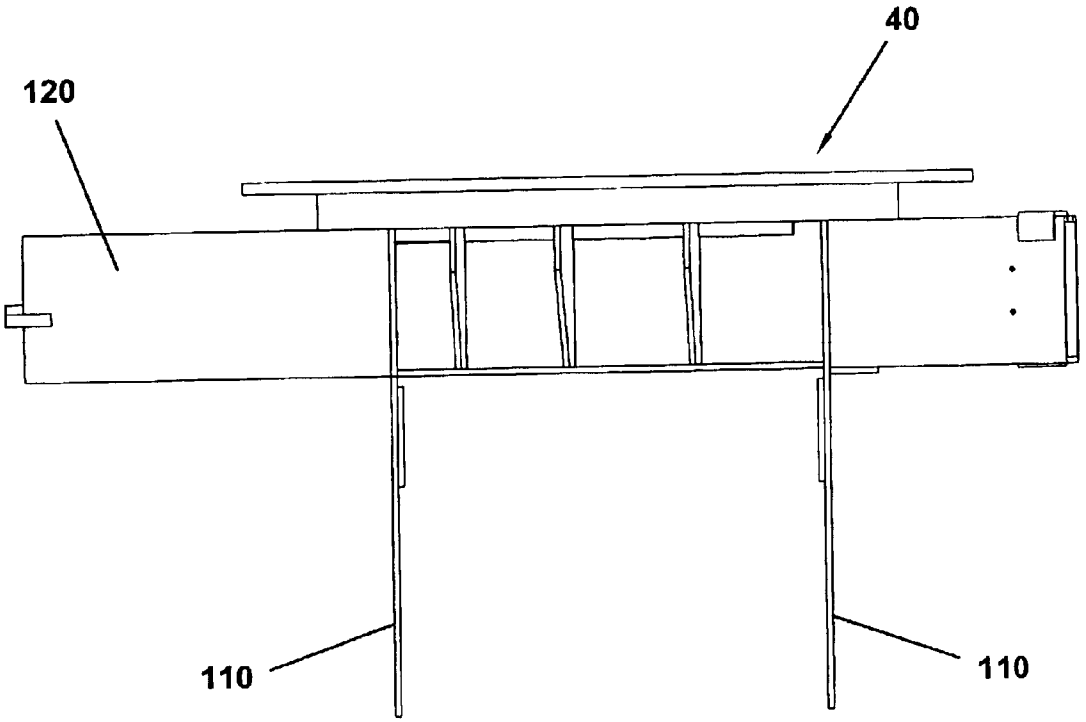
FIG. 14 is a rear elevational view of the turntable of FIGS. 12–13, wherein the lower housing portion is visible and the location of the upper pair of lateral stabilizers is indicated.

The extension ladder 50 of the fire engine 10 of the present invention is adapted to be rotated through substantially a 360 degree arc by the turntable 40. The extension ladder 50 is also equipped with a hydraulic lifting system 70 that allows it to be raised from a stored, substantially horizontal position (as shown in FIGS. 1 and 3–4) to a substantially vertical position (as shown in FIG. 8). The extension ladder 50 is also equipped with an extension system 80 of hydraulic cylinders and cables that allow each of its sections 90 to be extended so that the ladder assembly can be made increasingly longer in length.

Unlike known fire engine and extension ladder combinations, the fire engine 10 of the present invention allows the extension ladder 50 to be rotated fully through its 360 degree range of rotational motion, with the ladder fully extended and positioned at substantially any angle between horizontal and vertical. As described previously, locating the mounting position of the extension ladder 50 at substantially the center portion of the fire engine 10, allows the mass of the forward portion 20 and the rearward portion 30 to provide significant stabilization to the extended ladder assembly when it is located at or near the longitudinal axis of the fire engine. However, as the extended ladder 50 is rotated to a position away from the longitudinal axis of the fire engine 10, a moment is developed at the ladder support structure 60 and is translated to the framework of the fire engine through the turntable 40 to which it is attached. This moment tends to destabilize the fire engine 10 by causing it to lean in the direction of extension of the ladder 50. This destabilization is, of course, most acute when the extended ladder 50 is directed laterally to either side of the fire engine 10 and, therefore, substantially perpendicularly to the length thereof. In this position, the forward portion 20 and rearward portion 30 impart the least amount of stability to the fire engine 10. The degree of destabilization may depend somewhat on the terrain upon which the fire engine sits, and is also dependent on the vertical angle of the extended ladder assembly 50. As the angle of the extended ladder 50 approaches horizontal, the moment exerted on the ladder support structure 60 approaches its maximum. This is because in the horizontal position, the extended ladder 50 provides for the longest possible moment arm. Thus, the greatest chance for destabilization and a resultant leaning or tipping of the fire engine 10 will occur when the extension ladder 50 is fully extended in a substantially horizontal position, and directed laterally of the fire engine.

In order to minimize or prevent the leaning or tipping of the fire engine 10 when the extension ladder 50 is in a destabilizing position, the fire engine of the present invention employs a plurality of lateral stabilizers 100, preferably two on either side of the fire engine. As can be seen in FIGS. 3–11, the lateral stabilizers 100 are designed to extend outward from a position substantially beneath the ladder support structure 60, and to pass substantially through a turntable housing 110, which extends vertically downward from the upper portion of the turntable 40. When not in use, the majority of each lateral stabilizer 100 may be retracted to a position substantially within the turntable housing 110.

The lateral stabilizers 100 are each comprised of series of telescoping tubular sections 120 that fit concentrically, one within the other. The lateral stabilizers 100 are extended laterally outward by an internal, extending hydraulic cylinder 130 that is preferably located within each telescoping section 120. Each lateral stabilizer 100 also preferably has a leveling pad 140 or similar feature, that may be extended vertically downward from an end portion 150 of each lateral stabilizer once the stabilizer has been extended. A hydraulic leveling cylinder 160 is provided to extend and retract each leveling pad 140. The leveling pads 140 are provided to communicate with the ground, thereby imparting stabilization to the fire engine 10 through the lateral stabilizers 100. Each leveling pad 140 may be pivotally attached to its respective hydraulic leveling cylinder 160 so that the leveling pad is able to better communicate with uneven terrain. A cover plate 170 is preferably mounted to the end of each lateral stabilizer 100, such as to the hydraulic leveling cylinder 160 or its housing, so that when the lateral stabilizers are retracted they will be substantially undetectable. Preferably, the cover plates 170 are designed to fit into apertures 180 in the body of the fire engine 10 through which the lateral stabilizers 100 extend, such that when the lateral stabilizers are retracted, the affected portion of the fire engine body has a substantially uniform appearance. The cover plates 170 also help to prevent debris from accumulating around portions of the lateral stabilizers 100 and hydraulic leveling cylinders 160 when the fire engine 10 is in transit or not in use.

In order to conserve a maximum amount of space within the body of the fire engine 10 and to also provide the greatest amount of stabilization thereto, the lateral stabilizers 100 of the present invention are preferably disposed in pairs 190, 200. More than two lateral stabilizers 100 could also be employed on each side of the fire engine 10 if desired. As discussed above, the lateral stabilizers 100 are designed to extend outward from a position substantially beneath the turntable 40, and to pass substantially through the turntable housing 110. As such, each pair 190, 200 of lateral stabilizers is preferably arranged in substantially a "V" shape. In this arrangement, the ends of each stabilizer pair 190, 200 that are proximal to the turntable housing 110 are adjacent to one another, with each stabilizer pair 190, 200 diverging as the stabilizers extend laterally outward from the respective side of the fire engine 10. This design allows the lateral stabilizers 100 to reside in a compact arrangement when in a retracted position, but to provide stabilizing points that are spread over a significant area when extended. The design also allows the stabilizer pairs 190, 200 to communicate with the chassis of the fire engine 10 in order to effectuate the transfer of forces thereto. The design further allows for such an installation without interfering with the fire engine's drive train. To accomplish the "V" shaped orientation of the lateral stabilizers 100 through the turntable housing 110, one pair 190 of lateral stabilizers is disposed above the other pair 200. Thus, the leveling pads 140 of the upper stabilizer pair 190 will typically extend vertically downward a greater distance than the those of the lower stabilizer pair 200.

There may be occasions when extension of the hydraulic stabilizers 100 is restricted by an object or structure near the fire engine 10. Thus, it is preferable that the fire engine 10 be equipped with a monitoring system (not shown) that detects the position of each lateral stabilizer 100 as it extends, and determines if each lateral stabilizer has reached its fully extended position. Monitoring may be accomplished by limit switches, proximity sensors, or a number of other suitable, similar devices. Preferably, the monitoring system is in communication with the control system of the extension ladder 50, and can limit the ladder's range of motion depending on whether all of the lateral stabilizers 100 have reached their fully extended positions. The monitoring system and the ladder control system may interact in various ways. For example, the monitoring system may instruct the ladder control system to limit the extension ladder's 50 range of motion by an amount that is directly related to the percentage of full extension achieved by the lateral stabilizers 100. Alternatively, the monitoring system may instruct the ladder control system to limit the extension ladder's 50 motion to some predetermined range, any time full extension of the lateral stabilizers 100 is not achieved—regardless of what percentage of extension is actually accomplished.

In operation, the fire engine 10 is driven to a desired location. If the extension ladder 50 will be used, the fire engine 10 is properly located to allow the ladder to reach its intended destination, and the lateral stabilizers 100 are activated to extend from the fire engine. Once the lateral stabilizers 100 are outspread, the leveling pads 140 may be extended downward by the hydraulic leveling cylinders 160 until the leveling pads are in communication with the ground. Once the lateral stabilizers 100 have been secured, the extension ladder 60 may be extended and moved into position. If the monitoring system detects full extension of the lateral stabilizers 100, then the extension ladder 50 may be moved through its full range of motion. If the monitoring system detects less than full extension off the lateral stabilizers 100, the range of motion of the extension ladder 50 may be restricted.

As can be seen from the foregoing written description and accompanying drawings, the fire engine of the present invention provides the ability to reach areas of significant height that may have been previously inaccessible. The fire engine of the present invention provides a powered extension ladder of over 100 feet in length, which extension ladder may be safely moved through a more complete range of motion when loaded than the ladders of known fire engines. The fire engine of the present invention also provides a unique stabilization system that produces stabilization points located over a large area when deployed, but that requires little space when stored. While certain embodiments of the present invention are described in detail above, the scope of the invention is not to be considered limited by such disclosure, and modifications are possible without departing from the spirit of the invention as evidenced by the following claims:

What is claimed is:

1. A fire engine, said fire engine comprising:

(a) a forward portion;

(b) a rearward portion;

(c) a center portion located between said forward portion and said rearward portion, said center portion comprising:

(i) an extension ladder;

(ii) a turntable supporting said extension ladder so as to allow said extension ladder to rotate through an angle of substantially 360 degrees with respect to its vertical axis, and about 90 degrees with respect to its horizontal axis;

(iii) a turntable housing beneath said turntable;

(iv) a first set of at least two stabilizers located below said turntable and extending laterally outward through said turntable housing on one side of said fire engine; and (v) a second set of at least two stabilizers located below said turntable and extending laterally outward through said turntable housing on the opposite side of said fire engine wherein said first set of stabilizers define a V-shape that diverges as said stabilizers extend through said turntable housing, and said second set of stabilizers define a V-shape that diverges as said stabilizers extend though said turntable housing and wherein said first set of stabilizers and said second set of stabilizers are vertically offset with respect to one another.

2. A fire engine according to claim 1 wherein said first set of stabilizers and said second set of stabilizers are adjustable in the lateral direction.

3. A fire engine according to claim 1, wherein said first set of stabilizers and said second set of stabilizers each have ground engagement pads adjustable in the vertical direction.

4. A fire engine according to claim 1, wherein said rearward portion has no stabilizers.

5. A fire engine according to claim 1, wherein the laterally extending portion of said stabilizers is comprised of telescoping tubular sections.

6. A fire engine according to claim 5, further comprising hydraulic cylinders located within said tubular sections for extending said stabilizers.

7. A fire engine according to claim 1, further comprising a cover plate attached to a distal portion of each of said stabilizers, said cover plate adapted to cover an aperture in said turntable housing through which said stabilizers extend.

8. A fire engine according to claim 1, further comprising a monitoring system for detecting the position of each of said stabilizers during the extension thereof.

9. A fire engine according to claim 8, wherein said monitoring system is in communication with a control system for operating said ladder, said monitoring system adapted to limit the range of motion of said ladder if it detects less than full extension of one or more of said stabilizers.

10. A fire engine according to claim 1, wherein said stabilizers reside within the width of the body of said fire engine when in a retracted position.

11. A fire engine according to claim 1, wherein said extension ladder is in excess of 100 feet in length when fully extended.

12. A fire engine according to claim 11, wherein said extension ladder may be directed laterally from the fire engine when fully extended.

13. A fire engine according to claim 12, wherein said extension ladder may have a substantially horizontal orientation with respect to the ground.

14. A fire engine according to claim 12, wherein a load of about 1,000 pounds may be supported near a distal end of said extension ladder.

15. A fire engine, said fire engine comprising:

(a) a forward portion;

(b) a rearward portion;

(c) a center portion located between said forward portion and said rearward portion, and between the axles of said fire engine, said center portion comprising:

(i) an extension ladder;

(ii) a ladder support structure for coupling a proximal end of said extension ladder to a turntable;

(iii) a tumtable coupled to said proximal end of said extension ladder, so as to a low said extension ladder to sweep though an angle of substantially 360 degrees with respect to its vertical axis, said turntable in communication with the chassis of said fire engine;

(iv) a lifting mechanism for raising said extension ladder from between a position substantially horizontal to the ground to a position substantially 90 degrees with respect to the ground;

(v) a turntable housing beneath said turntable;

(vi) a first set of at least two stabilizers, each stabilizer having a substantially horizontal and laterally extending portion, and a vertically extending portion adapted to contact the ground and attached to a distal end of said laterally extending portion, the laterally extending portions extending divergingly outward through said turntable housing on one side of said fire engine; and (vii) a second set of at least two stabilizers, each stabilizer having a substantially horizontal and laterally extending portion, and a vertically extending portion adapted to contact the ground and attached to a distal end of said laterally extending portion, the laterally extending portions extending divergingly outward through said turntable housing on one side of said fire engine;

wherein said first set of stabilizers and said second set of stabilizers are vertically offset from one another; and wherein said stabilizers provide for additional points of contact with the ground when said extension ladder is extended, thereby preventing the destabilization of said fire engine.

16. A fire engine, said fire engine comprising:

(a) a forward portion;

(b) a rearward portion;

(c) a center portion located between said forward portion and said rearward portion, said center portion comprising:

(i) an extension ladder;

(ii) a turntable supporting said extension ladder so as to allow said extension ladder to rotate through an angle of substantially 360 degrees with respect to its vertical axis, and about 90 degrees with respect to its horizontal axis;

(iii) a turntable housing beneath said turntable;

(iv) a first set of at least two stabilizers located below said turntable and extending laterally outward through said turntable housing on one side of said fire engine; and (v) a second set of at least two stabilizers located below said turntable and extending laterally outward through said turntable housing on the opposite side of said fire engine;

and each of said stabilizers comprising a cover plate attached to a distal portion of each of said stabilizers, said cover plate adapted to cover an aperture in said turntable housing through which said stabilizers extend.

17. A fire engine according to claim 16, wherein said first set of stabilizers define a V-shape that diverges as said stabilizers extend through said turntable housing, and said second set of stabilizers define a V-shape that diverges as said stabilizers extend though said turntable housing.

18. A fire engine according to claim 16 wherein said first set of stabilizers and said second set of stabilizers are vertically offset with respect to one another.

19. A fire engine according to claim 16 wherein said first set of stabilizers and said second set of stabilizers are adjustable in the lateral direction.

20. A fire engine according to claim 16, wherein said first set of stabilizers and said second set of stabilizers each have ground engagement pads adjustable in the vertical direction.

21. A fire engine according to claim 16, wherein said rearward portion has no stabilizers.

22. A fire engine according to claim 16, wherein the laterally extending portion of said stabilizers is comprised of telescoping tubular sections.

23. A fire engine according to claim 22, further comprising hydraulic cylinders located within said tubular sections for extending said stabilizers.

24. A fire engine according to claim 16, further comprising a monitoring system for detecting the position of each of said stabilizers during the extension thereof.

25. A fire engine according to claim 24, wherein said monitoring system is in communication with a control system for operating said ladder, said monitoring system adapted to limit the range of motion of said ladder if it detects less than full extension of one or more of said stabilizers.

26. A fire engine according to claim 16, wherein said stabilizers reside within the width of the body of said fire engine when in a retracted position.

27. A fire engine according to claim 16, wherein said extension ladder is in excess of 100 feet in length when fully extended.

28. A fire engine according to claim 27, wherein said extension ladder may be directed laterally from the fire engine when fully extended.

29. A fire engine according to claim 28, wherein said extension ladder may have a substantially horizontal orientation with respect to the ground.

30. A fire engine according to claim 28, wherein a load of about 1,000 pounds may be supported near a distal end of said extension ladder.

31. A fire engine, said fire engine comprising:

(a) a forward portion;

(b) a rearward portion;

(c) a center portion located between said forward portion and said rearward portion, said center portion comprising:

(i) an extension ladder;

(ii) a turntable supporting said extension ladder so as to allow said extension ladder to rotate through an angle of substantially 360 degrees with respect to its vertical axis, and about 90 degrees with respect to its horizontal axis;

(iii) a turntable housing beneath said turntable;

(iv) a first set of at least two stabilizers located below said turntable and extending laterally outward through said turntable housing on one side of said fire engine; and (v) a second set of at least two stabilizers located below said turntable and extending laterally outward through said turntable housing on the opposite side of said fire engine;

said fire engine further comprising a monitoring system for detecting the position of each of said stabilizers during the extension thereof, and wherein said monitoring system is in communication with a control system for operating said ladder, said monitoring system adapted to limit the range of motion of said ladder if it detects less than full extension of one or more of said stabilizers.

32. A fire engine according to claim 31, wherein said first set of stabilizers define a V-shape that diverges as said stabilizers extend through said turntable housing, and said second set of stabilizers define a V-shape that diverges as said stabilizers extend though said turntable housing.

33. A fire engine according to claim 31, wherein said first set of stabilizers and said second set of stabilizers are vertically offset with respect to one another.

34. A fire engine according to claim 31 wherein said first set of stabilizers and said second set of stabilizers are adjustable in the lateral direction.

35. A fire engine according to claim 31, wherein said first set of stabilizers and said second set of stabilizers each have ground engagement pads adjustable in the vertical direction.

36. A fire engine according to claim 31, wherein said rearward portion has no stabilizers.

37. A fire engine according to claim 31, wherein the laterally extending portion of said stabilizers is comprised of telescoping tubular sections.

38. A fire engine according to claim 37, further comprising hydraulic cylinders located within said tubular sections for extending said stabilizers.

39. A fire engine according to claim 31, further comprising a cover plate attached to a distal portion of each of said stabilizers, said cover plate adapted to cover an aperture in said turntable housing through which said stabilizers extend.

40. A fire engine according to claim 31, wherein said stabilizers reside within the width of the body of said fire engine when in a retracted position.

41. A fire engine according to claim 31, wherein said extension ladder is in excess of 100 feet in length when fully extended.

42. A fire engine according to claim 40, wherein said extension ladder may be directed laterally from the fire engine when fully extended.

43. A fire engine according to claim 41, wherein said extension ladder may have a substantially horizontal orientation with respect to the ground.

44. A fire according to claim 41, wherein a load of about 1,000 pounds may be supported near a distal end of said extension ladder.

* * * * *